US006793524B2

(12) United States Patent
Clark et al.

(10) Patent No.: US 6,793,524 B2
(45) Date of Patent: Sep. 21, 2004

(54) MULTIMEDIA OUTLET WITH PROTECTIVE COVER

(75) Inventors: Gordon P. Clark, Eden Prairie, MN (US); David G. Coppock, Bloomington, MN (US); Loren J. Mattson, Richfield, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 381 days.

(21) Appl. No.: 09/823,234

(22) Filed: Mar. 30, 2001

(65) Prior Publication Data

US 2002/0142650 A1 Oct. 3, 2002

(51) Int. Cl.[7] ..... H01R 13/74
(52) U.S. Cl. ..... 439/536
(58) Field of Search ..... 439/536, 535, 439/488, 491, 538, 539; 174/66

(56) References Cited

U.S. PATENT DOCUMENTS

| | | | | |
|---|---|---|---|---|
| 1,930,610 A | | 10/1933 | Despard | |
| 3,494,244 A | * | 2/1970 | Wayland | |
| 3,921,798 A | | 11/1975 | Dean et al. | |
| 4,756,695 A | * | 7/1988 | Lane | 439/535 |
| 4,835,343 A | * | 5/1989 | Graef et al. | 174/66 |
| 4,875,880 A | * | 10/1989 | Welsh | 439/536 |
| 5,457,286 A | * | 10/1995 | Flasz | 174/66 |
| 5,484,307 A | * | 1/1996 | Garthwaite et al. | 439/535 |
| 5,575,100 A | | 11/1996 | Marvin et al. | |
| 5,613,874 A | | 3/1997 | Orlando et al. | |
| 5,708,705 A | | 1/1998 | Yamashita et al. | |
| 5,744,750 A | * | 4/1998 | Almond | 174/66 |
| 5,775,935 A | * | 7/1998 | Barna | 439/488 |
| 5,862,616 A | | 1/1999 | Peroni | |
| 5,933,994 A | | 8/1999 | Misaresh | |
| 5,961,345 A | | 10/1999 | Finn et al. | |
| 6,056,593 A | * | 5/2000 | Strang et al. | |

FOREIGN PATENT DOCUMENTS

DE 8708237 9/1987

OTHER PUBLICATIONS

ADC Telecommunications Enteraprise Catalog for 5000E and 3000 Multimedia Outlets dated Apr. 1999.
ADC Telecommunications Enteraprise Catalog of Patch Panels dated Dec. 2000.
The Siemon Company Catalog, pp. 120–121 (1997).
Exhibit A, Photographs of bezel corresponding to bezels shown in Dec. 2000 ADC catalog referenced above.

* cited by examiner

*Primary Examiner*—Neil Abrams
(74) *Attorney, Agent, or Firm*—Merchant & Gould P.C.

(57) ABSTRACT

A cover assembly for covering an outlet box. The assembly includes a cover plate and an insert piece having a middle member and two retention members. The cover plate defines a cover aperture which receives the middle member of the insert piece from a back side of the cover plate. The retention members of the insert piece abut the back side of the cover plate. The insert piece may define a connector aperture for receiving a cable connector and may include designation figures. The assembly may also include a strap defining mounting apertures for receiving snap-fit connector modules. The strap may define shelves along two opposed sides for receiving the retention members of an insert piece. The strap may also define tab slots for receiving tabs of the insert piece.

35 Claims, 13 Drawing Sheets

50
74
76
81
82
83
84
85
90
92
53
80
213

100
210
110
102
112
102
205
100

112
205
100
110

100
211
102
112
210
110

100
211
102
112
206
110

110
211
100
210
112
205

110
100
211
102
112
206
102

MULTIMEDIA OUTLET WITH PROTECTIVE COVER

FIELD OF THE INVENTION

The present invention relates to covers for use on multimedia outlets or other telecommunication outlets.

BACKGROUND OF THE INVENTION

Multimedia outlets typically include a variety of cable connectors or jacks mounted in an outlet box for receiving cables carrying telecommunications signals. The connectors and jacks might include video, computer, or telephone data connectors such as coaxial cable connectors, twisted pair connectors, or fiber optic connectors. Because the connectors are used for different applications, there is a need for a connector designation system for distinguishing each connector in a multimedia outlet.

In addition, the connectors may be mounted into outlet boxes using snap-fit connector modules. Although snap-fit connector modules allow for easy assembly, it is desirable to prevent the modules from being removed from the multimedia outlet too easily. Therefore, there is a need to retain the various assemblies preventing the modules from being removed from the multimedia outlet.

SUMMARY OF THE INVENTION

One aspect of the present invention relates to a cover assembly for covering an outlet box. The assembly includes a cover plate and an insert piece having a middle member and two retention members. The cover plate defines a cover aperture which receives the middle member of the insert piece. The retention members of the insert piece abut a back surface of the cover plate. The insert piece may define a connector aperture for receiving a cable connector.

Another aspect of the present invention relates to incorporating designation figures on the insert piece as described above. The insert piece may also include tabs extending from a rear surface of the insert piece.

A further aspect of the present invention relates to a strap for use with the assembly described above. The strap defines mounting apertures for receiving snap-fit connector modules. The strap may define shelves along two opposed sides for receiving the retention members of an insert piece. The strap may also define tab slots for receiving the tabs of the insert piece.

DETAILED DESCRIPTION OF THE PREFERRED EMBODIMENTS

Figure 1:
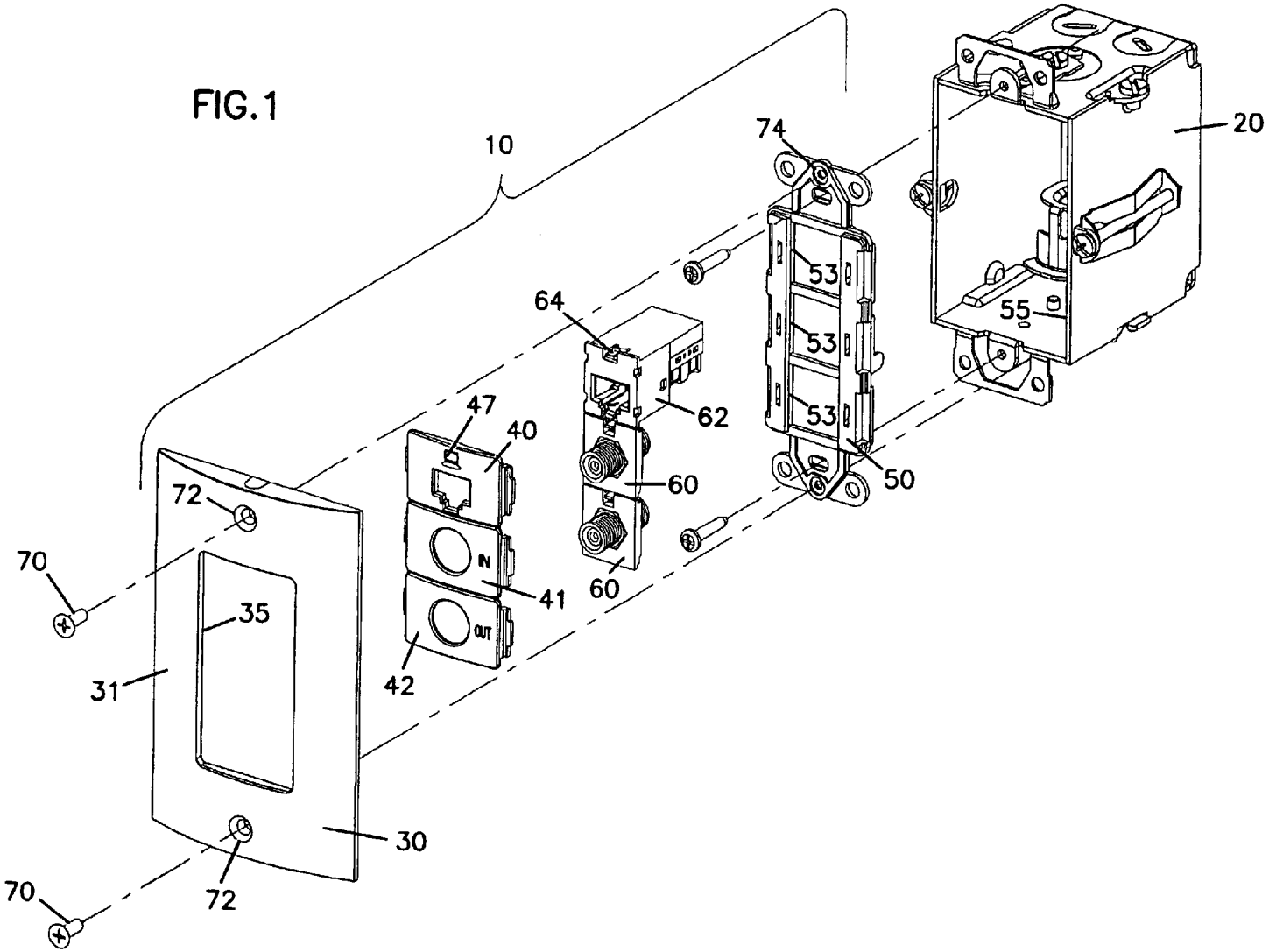
FIG. 1 is an exploded perspective view of an assembly according to the present invention with an outlet box.
Figure 2:
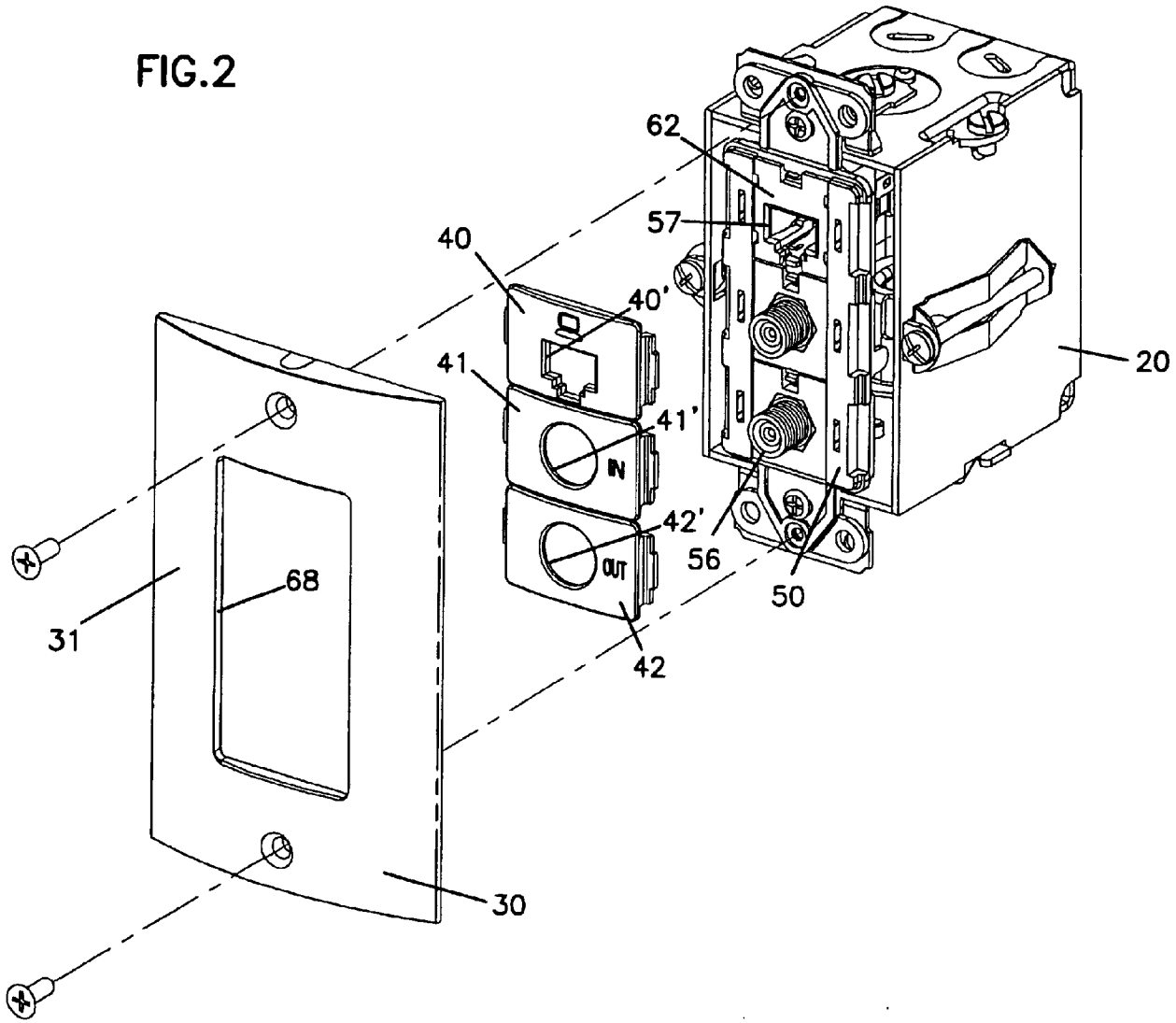
FIG. 2 is a partially exploded perspective view of the assembly of FIG. 1 with the strap coupled to the outlet box.
Figure 3:
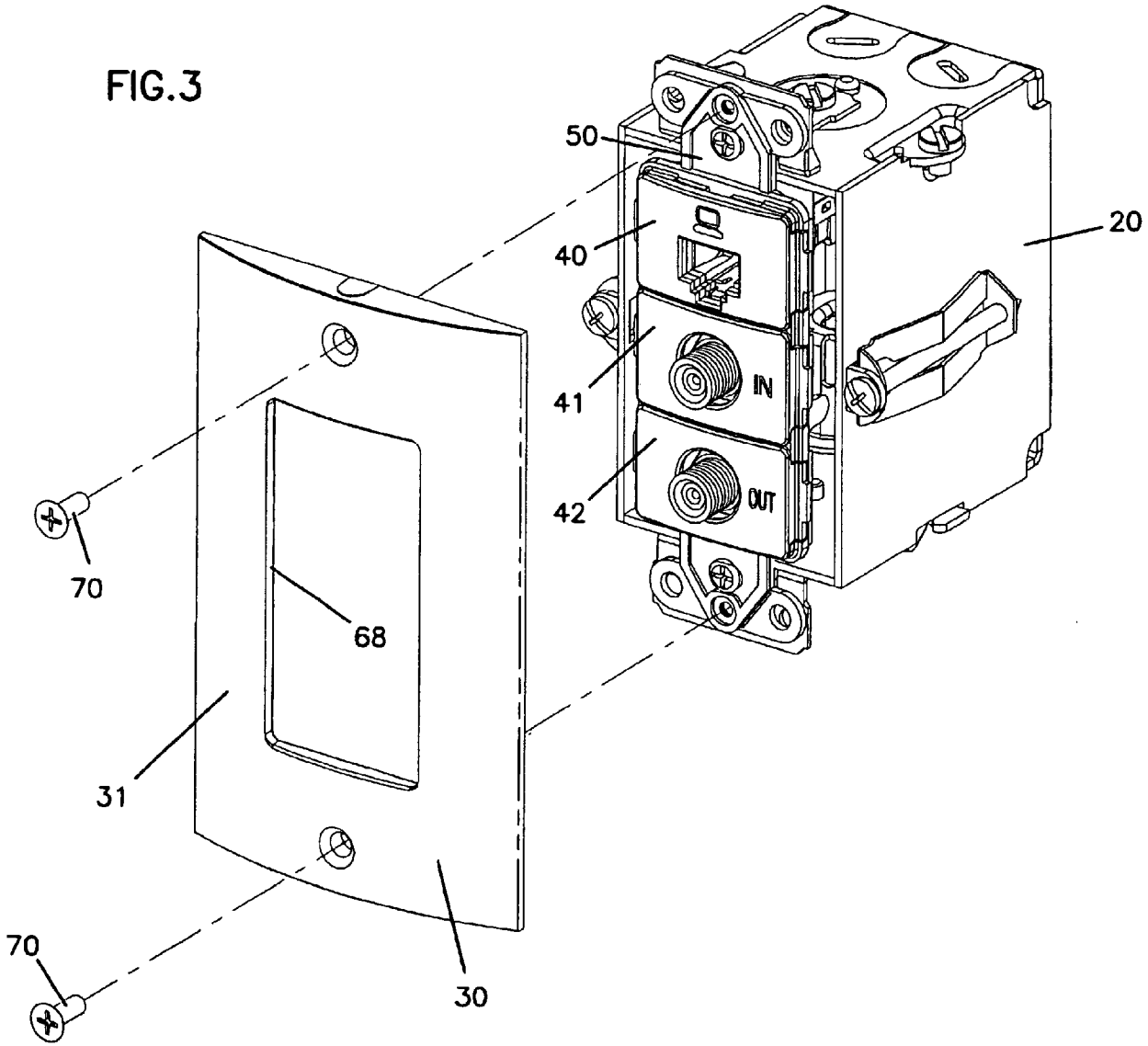
FIG. 3 is a partially exploded perspective view of the assembly of FIG. 1 with the insert pieces mounted in the strap.

FIGS. 1–5 show a cover assembly 10 according to the present invention with an outlet box 20. The assembly 10 includes a cover plate 30, insert pieces 40, 41, and 42, and a strap 50. Strap 50 is configured to span an open end 55 of the outlet box 20. The strap 50 defines mounting apertures 53 for receiving connector modules 60 and 62. Connector modules 60 and 62 include cable connectors 56 or jacks 57. Insert pieces 40, 41, and 42 fit within a cover aperture 68 defined by the cover plate 30. The cover plate 30 holds the insert pieces against the strap 50. The insert pieces 40, 41, and 42 define connector apertures 40', 41', and 42' for receiving connectors 56 mounted in the connector modules 60 or for receiving a connector into the jack 57 in connector module 62.

Figure 7:
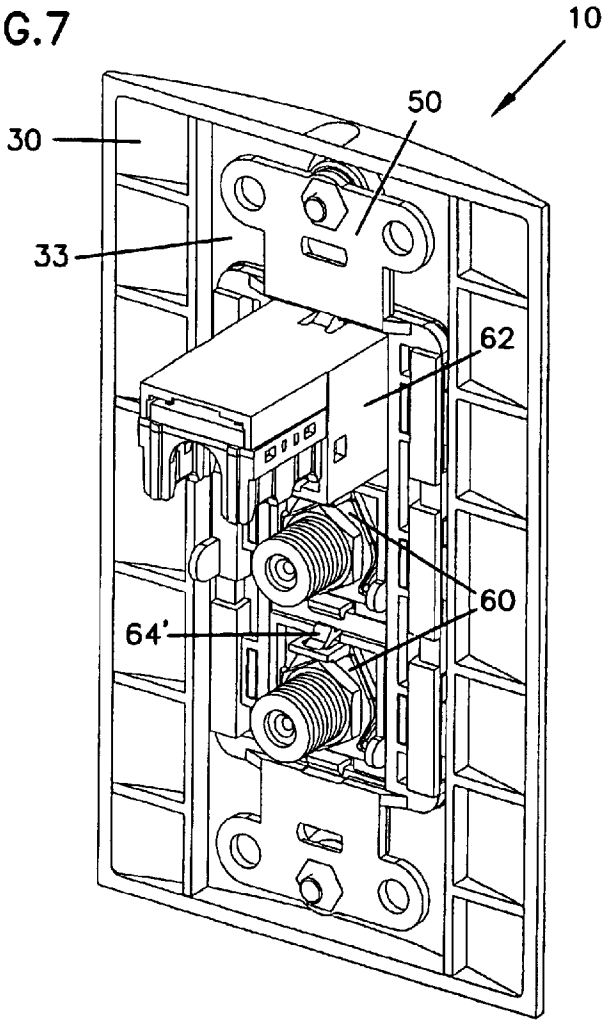
FIG. 7 is a rear perspective view of the assembly of FIG. 6.
Figure 6:
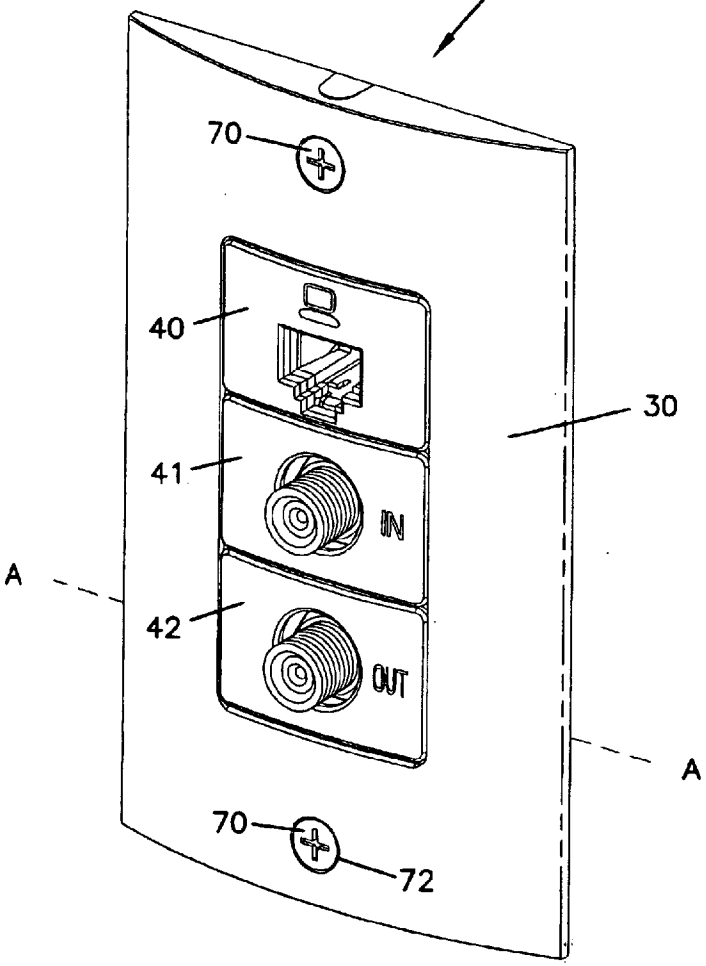
FIG. 6 is a front perspective view of an assembly according to the present invention with connector modules mounted in the strap.
Figure 35:
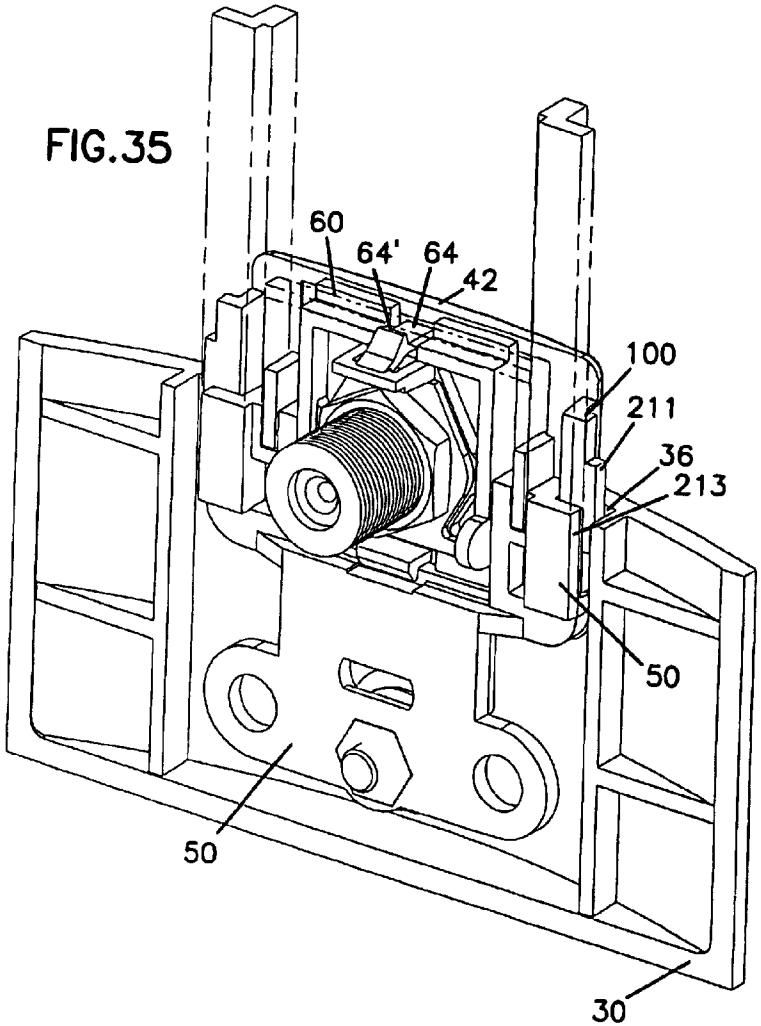
FIG. 35 is a rear perspective view of the assembly of FIG. 34.

FIGS. 6 and 7 show assembly 10 with the outlet box removed. The connector modules 60 and 62 are snap-fit modules which include flexible push tabs 64 having a ramped lip 64'. Modules 60 and 62 may be inserted and removed from a frontside of the strap 50 by depressing the push tabs 64. In FIG. 35, the connector module 60 is shown to be engaged to the strap 50. A portion of the strap 50 is shown with phantom lines for clarity purposes to illustrate the ramped lip 64' of the flexible push tab 64 of the connector module 60 engaged to the strap 50. Screws 70 couple the strap 50 to the cover plate 30 through fastener holes 72 and 74 defined by the cover plate and the strap 50.

The insert pieces 40–42 overlap at least a portion of corresponding mounting apertures 53 in the strap 50. The insert pieces 40–42 prevent modules 60 and 62 from being removed from the strap 50 without first removing the cover plate 30 and insert pieces. Furthermore, the insert pieces themselves cannot be removed unless the cover plate 30 is first removed from the assembly 10.

FIGS. 8–12 illustrate a strap 50 according to the present invention. The strap 50 defines a plurality of mounting apertures 53 for mounting connector modules 60 to the outlet box 20. The strap 50 has a front surface 80, a back surface 82, and an outside edge 81 which includes two sides 83 and 84. The outside edge 81 is recessed from the front surface 80, thereby forming a lip 85 around the outside edge of the strap 50. The front surface 80 of the strap 50 fits within the cover aperture 68 from a back side 33 of the cover plate 30 so that the lip 85 of the strap 50 abuts the back side 33 of the cover plate 30.

Figures 8, 9, 10, 11, 12:
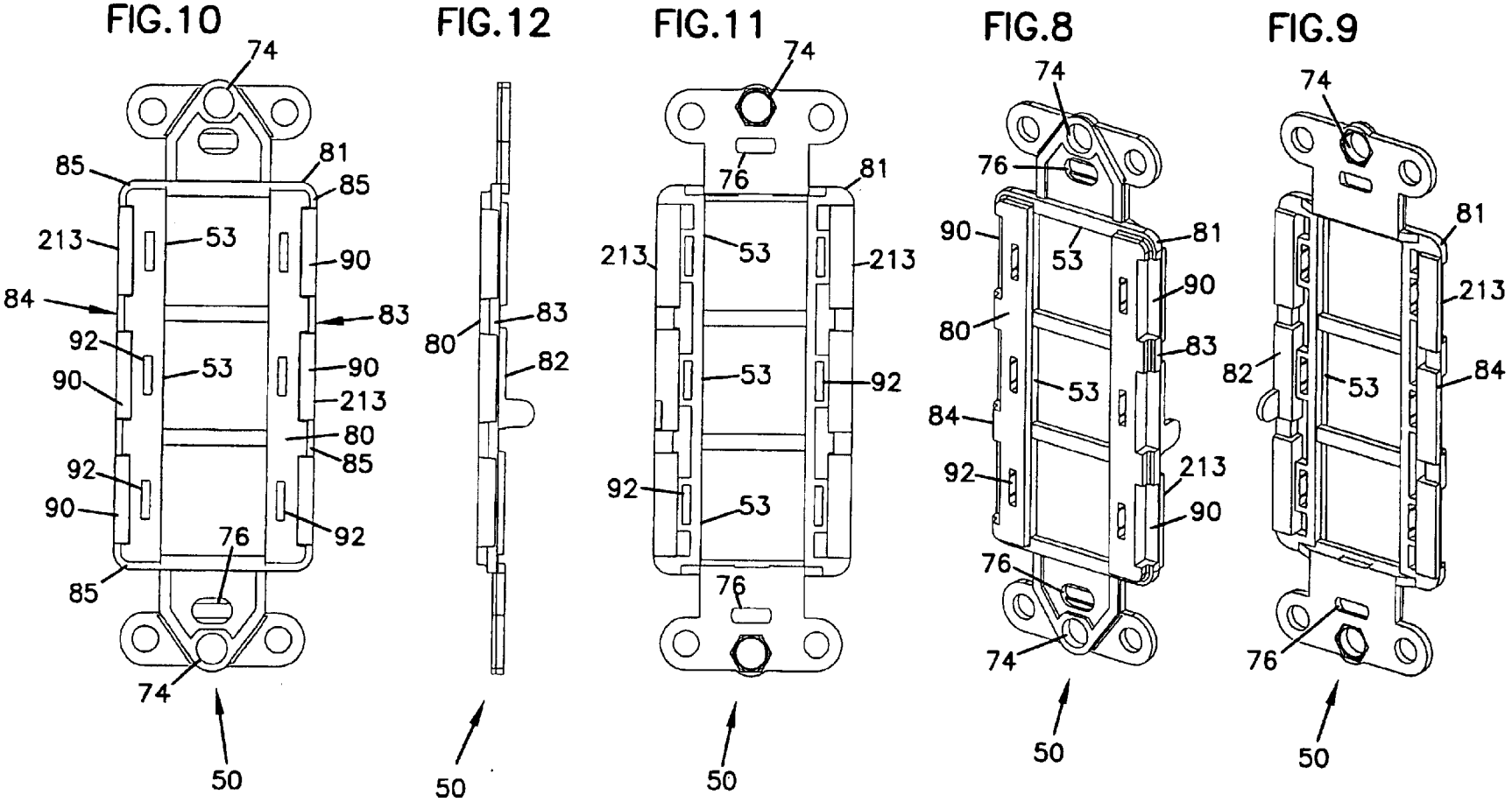
FIG. 8 is a front perspective view of a strap according to the present invention.
FIG. 9 is a rear perspective view of the strap of FIG. 8.
FIG. 10 is a front view of the strap of FIG. 8.
FIG. 11 is a rear view of the strap of FIG. 8.
FIG. 12 is a side view of the strap of FIG. 8.
Figures 13, 14, 15, 16, 17, 18:
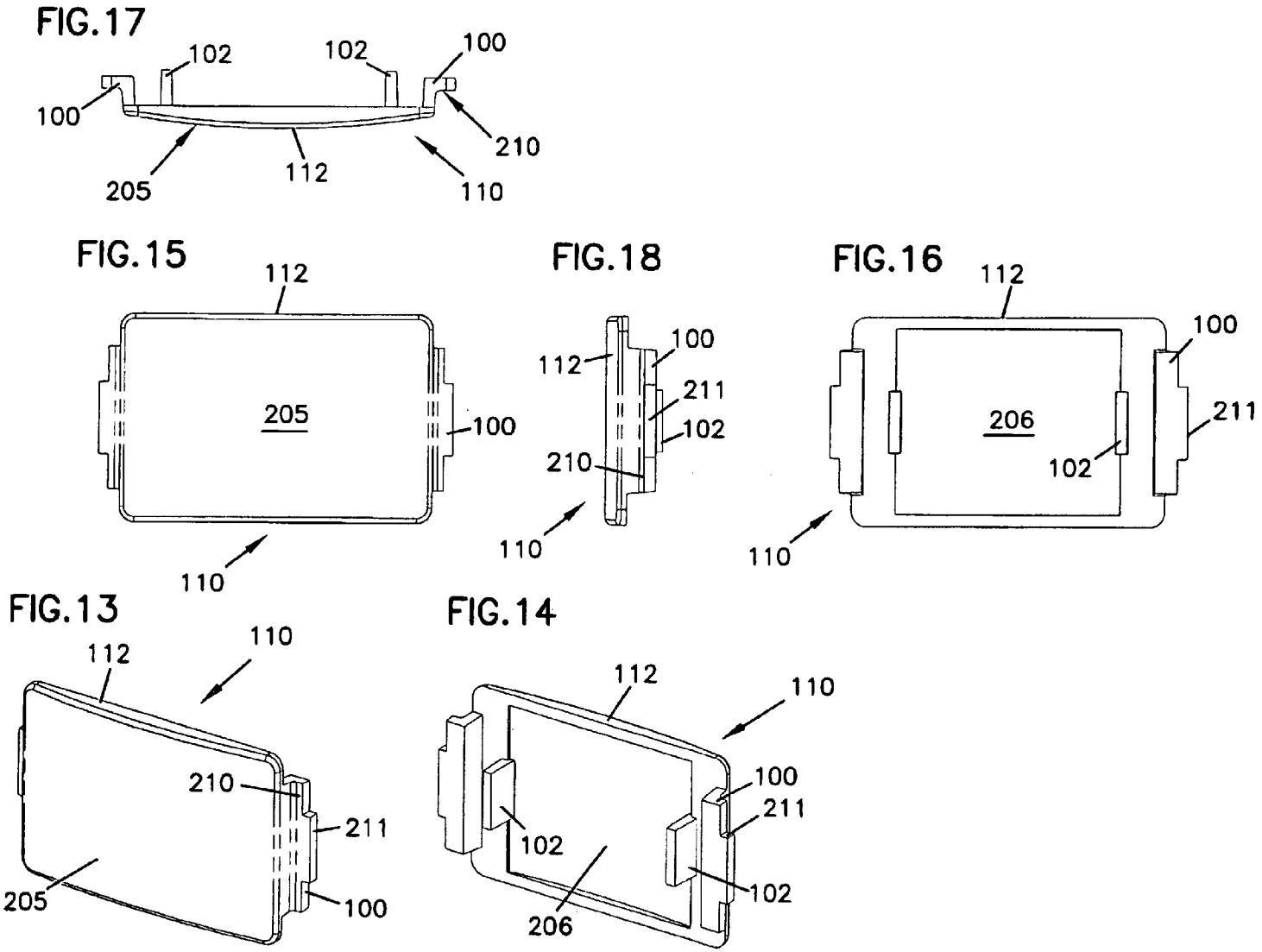
FIG. 13 is a front perspective view of a blank insert piece according to the present invention.
FIG. 14 is a rear perspective view of the insert piece of FIG. 13.
FIG. 15 is a front view of the insert piece of FIG. 13.
FIG. 16 is rear view of the insert piece of FIG. 13.
FIG. 17 is a top view of the insert piece of FIG. 13.
FIG. 18 is a side view of the insert piece of FIG. 13.

As shown in FIG. 8, sides 83 and 84 of the strap 50 define recessed shelves 90. The shelves 90 are shaped to receive side retention members 100 of the insert pieces 40–42. Strap 50 may also define tab slots 92 in the front surface 80 for receiving tabs 102 of the insert pieces.

The strap 50 defines fastener holes 74 for securing the strap 50 to the cover plate 30. The strap 50 also defines fastener holes 76 for securing the strap 50 to an outlet box 20.

FIGS. 13–18 show a blank insert piece 110 according to the present invention. Each insert piece in the assembly 10 corresponds to one or more mounting apertures 53 in the strap 50. The insert pieces cover the mounting apertures 53 and the connector modules 60 received in the mounting apertures 53 so that the modules 60 cannot be removed without first removing the insert pieces. Blank insert piece 110 may be used as a dust cap to cover an unused jack to prevent dust or other foreign material from entering the jack or may be used to cover an empty mounting aperture.

Figures 19, 20, 21, 22, 23, 24, 25, 26, 27:
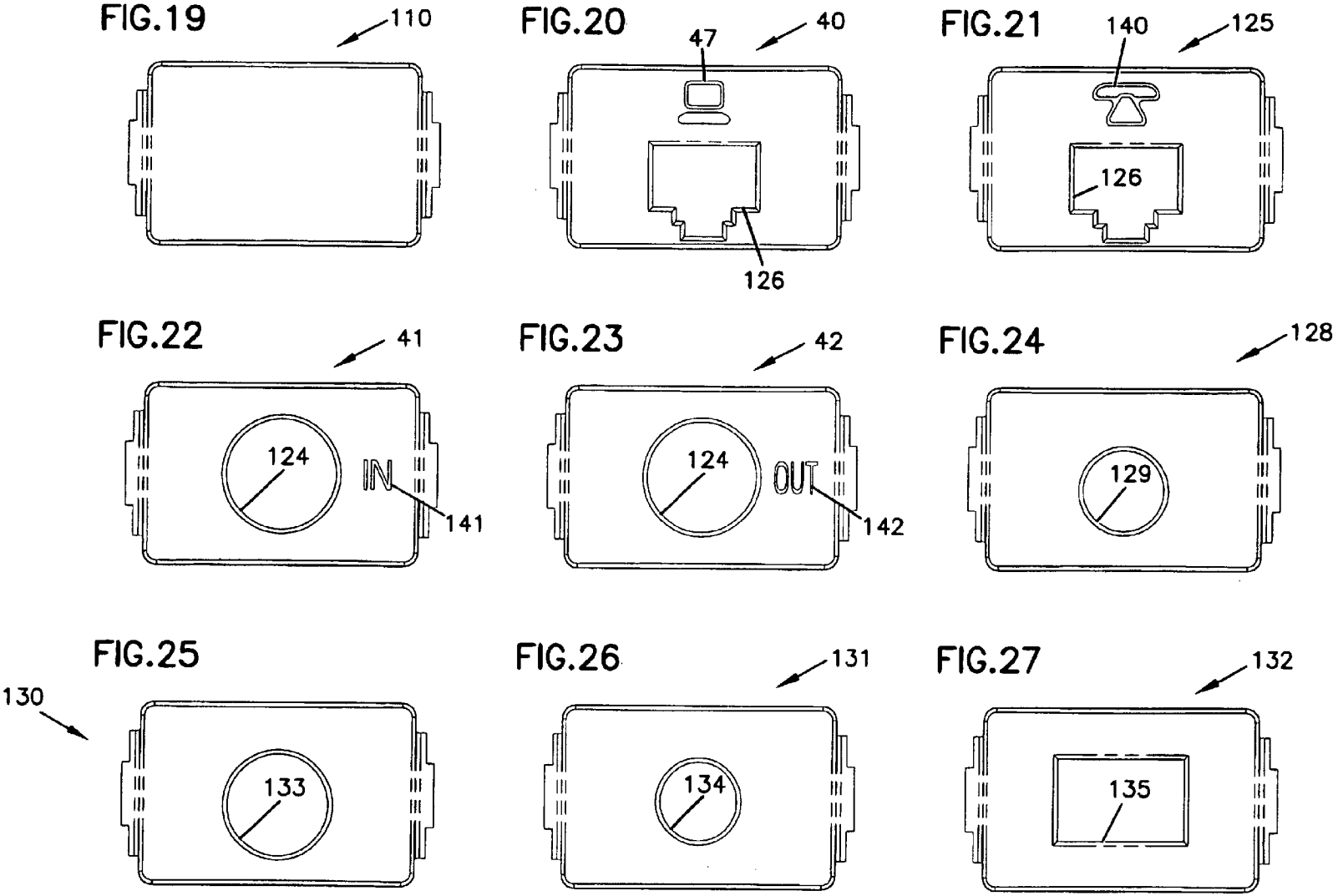
FIG. 19 is a front view of the insert of FIG. 13.
FIG. 20 is a front view of an example of a computer data insert piece according to the present invention.
FIG. 21 is a front view of a telephone or voice insert piece according to the present invention.
FIG. 22 is a front view of a video IN insert piece according to the present invention.
FIG. 23 is a front view of a video OUT insert piece according to the present invention.
FIG. 24 is a front view of an RCA insert piece according to the present invention.
FIG. 25 is a front view of an S-video insert piece according to the present invention.
FIG. 26 is a front view of a fiber ST insert piece according to the present invention.
FIG. 27 is a front view of a fiber SC insert piece according to the present invention.
Figure 29:
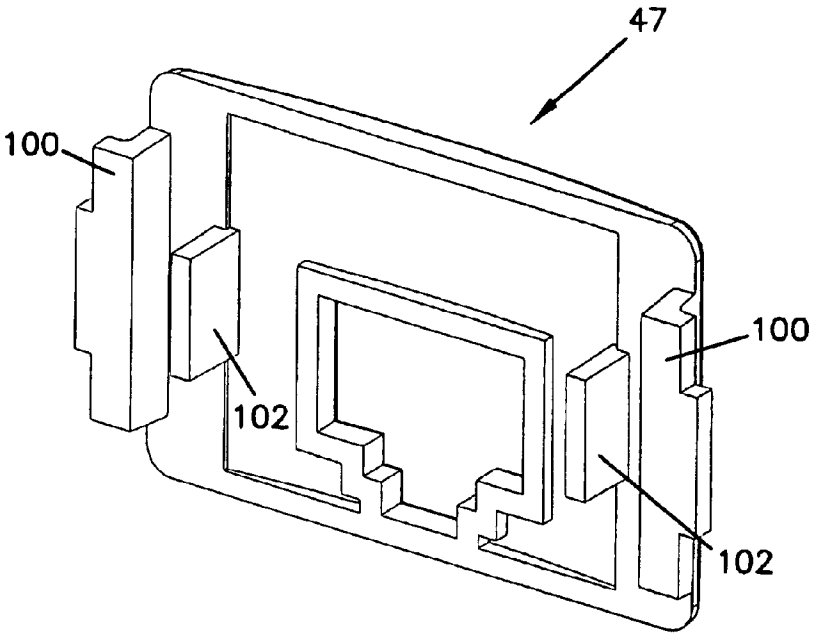
FIG. 29 is a rear perspective view of the insert of FIG. 20.

Other embodiments of insert pieces according to the present invention, as shown in FIGS. 20–33, include connector apertures for receiving a cable connector mounted in a mounting aperture 53 of the strap 50 to pass through the insert member or for allowing a connector on an end of a cable to be received by a jack under the insert piece. The connector apertures may be sized and shaped to correspond to various types of connectors or jacks. For example FIGS. 20 and 21 show insert pieces 40 and 125 having a twisted pair plug aperture 126. FIGS. 22 and 23 show insert pieces 41 and 42 having a video connector aperture 124. FIG. 24 shows an insert piece 128 having an RCA connector aperture 129. FIGS. 25–27 show insert pieces 130–132 having other variously shaped connector apertures 133–135. Other shapes can be used as desired for different connector styles.

Figure 28:
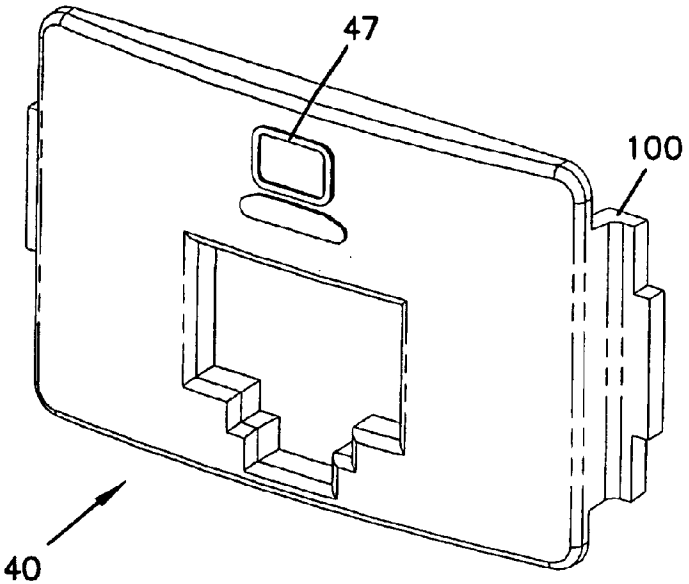
FIG. 28 is a front perspective view of the insert of FIG. 20.
Figure 31:
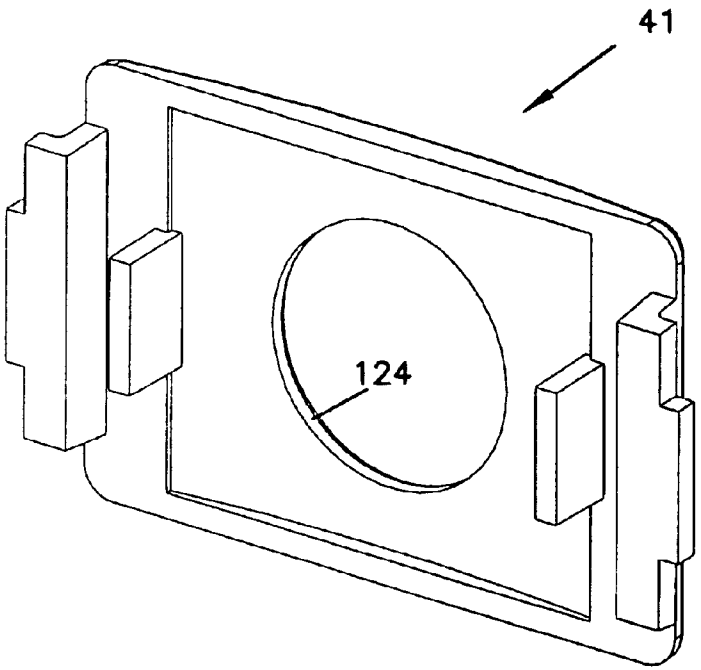
FIG. 31 is a rear perspective view of the insert of FIG. 22.
Figure 30:
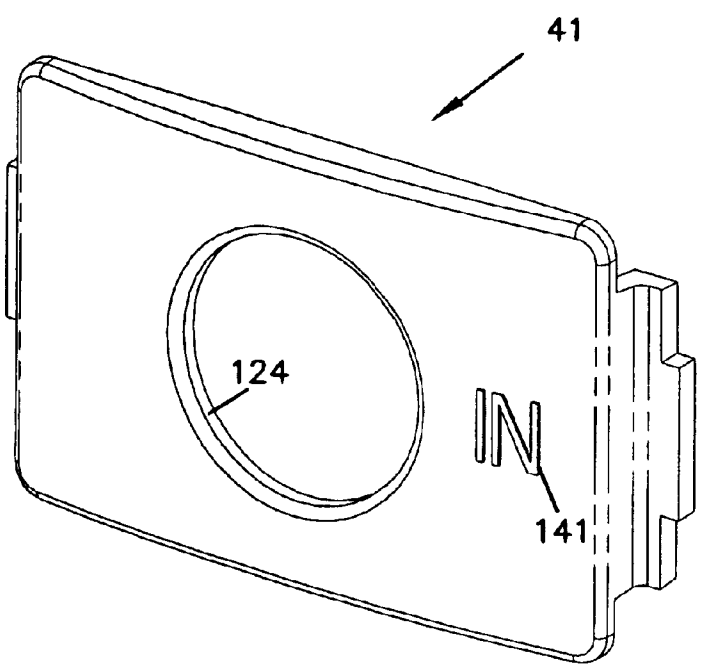
FIG. 30 is a front perspective view of the insert of FIG. 22.
Figure 33:
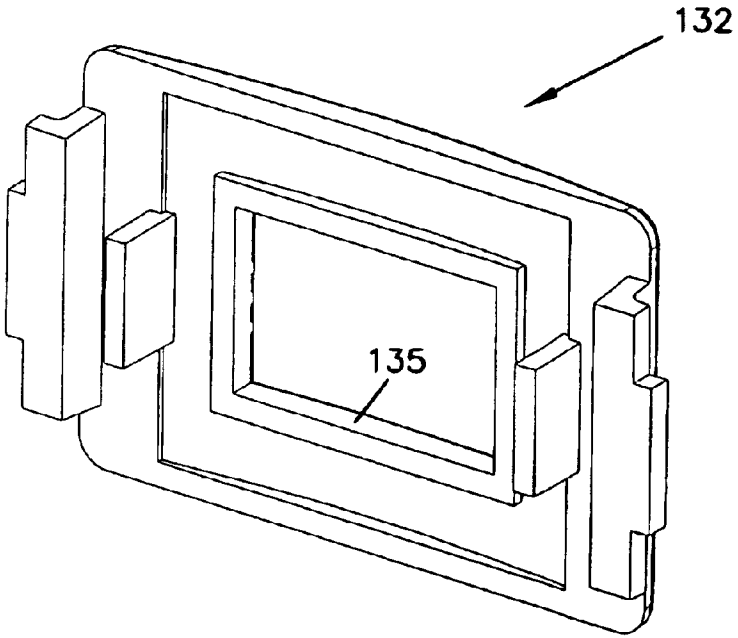
FIG. 33 is a rear perspective view of the insert of FIG. 27.
Figure 32:
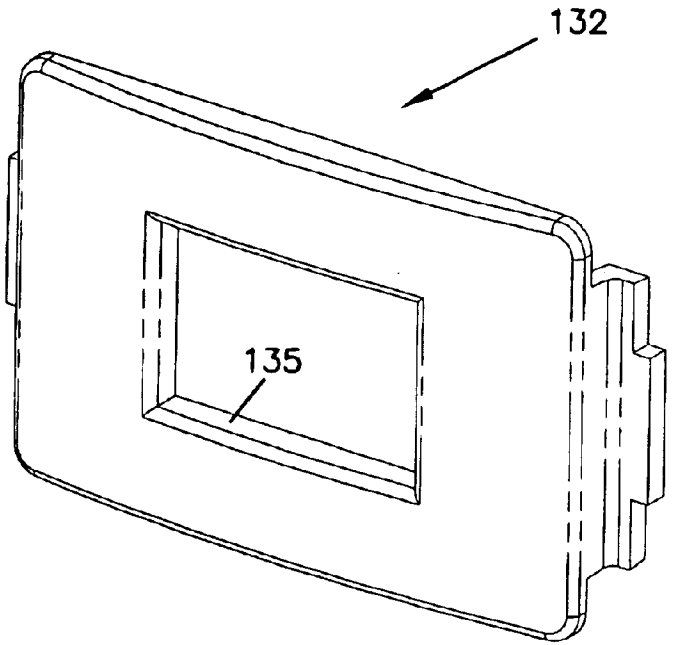
FIG. 32 is a front perspective view of the insert of FIG. 27.

The insert pieces may also include designation figures which identify the different applications using a connector or jack in the corresponding mounting aperture 53. For example, the insert piece 40 shown in FIGS. 20 and 28 shows a computer figure 47 which may be used to designate that insert piece 40 corresponds to a computer data jack or port. Similarly, insert pieces 125, 41 and 42 include designation figures. 140, 141, and 142 indicating telephone, video IN, and video OUT connectors or jacks respectively. The insert pieces may also be color coded in order to differentiate between connector and jack types.

Referring now to FIGS. 13–18, an insert piece according to the present invention such as insert piece 110 includes a middle member 112 having front and rear surfaces 205 and 206. In the illustrated embodiments, the front surface 205 is shaped to correspond to the shape of a front surface 31 of the cover plate 30. For example, the front surface 205 of the insert piece is curved to follow the curved front surface 31 of the cover plate 30.

Figure 5:
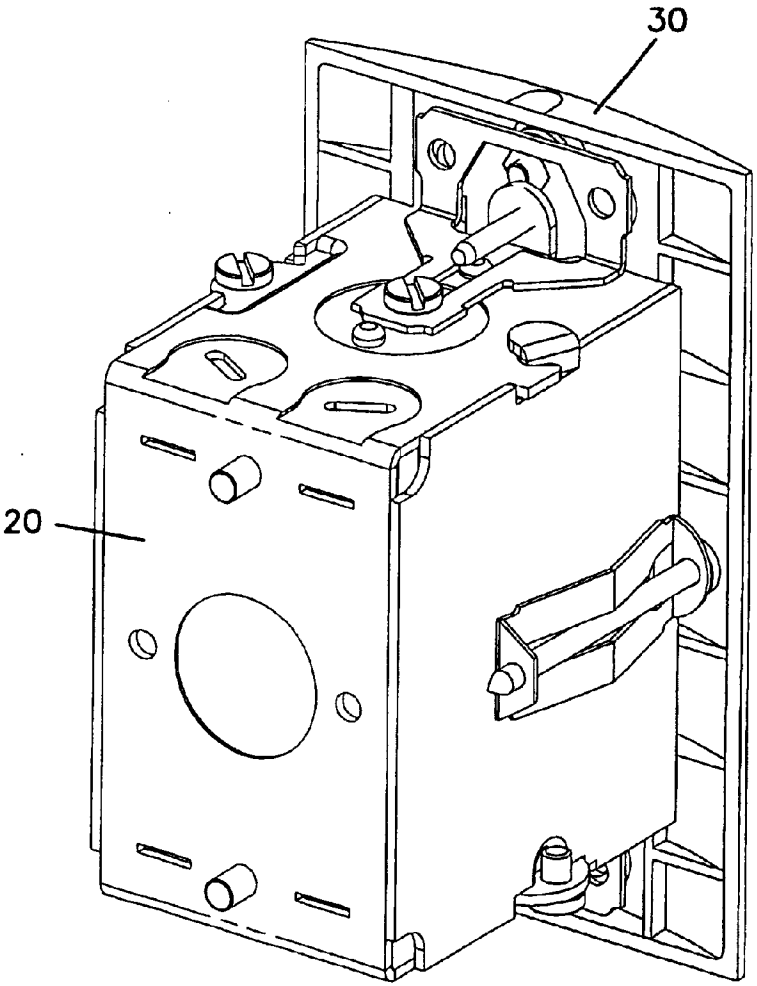
FIG. 5 is a rear perspective view of the assembly of FIG. 1.
Figure 4:
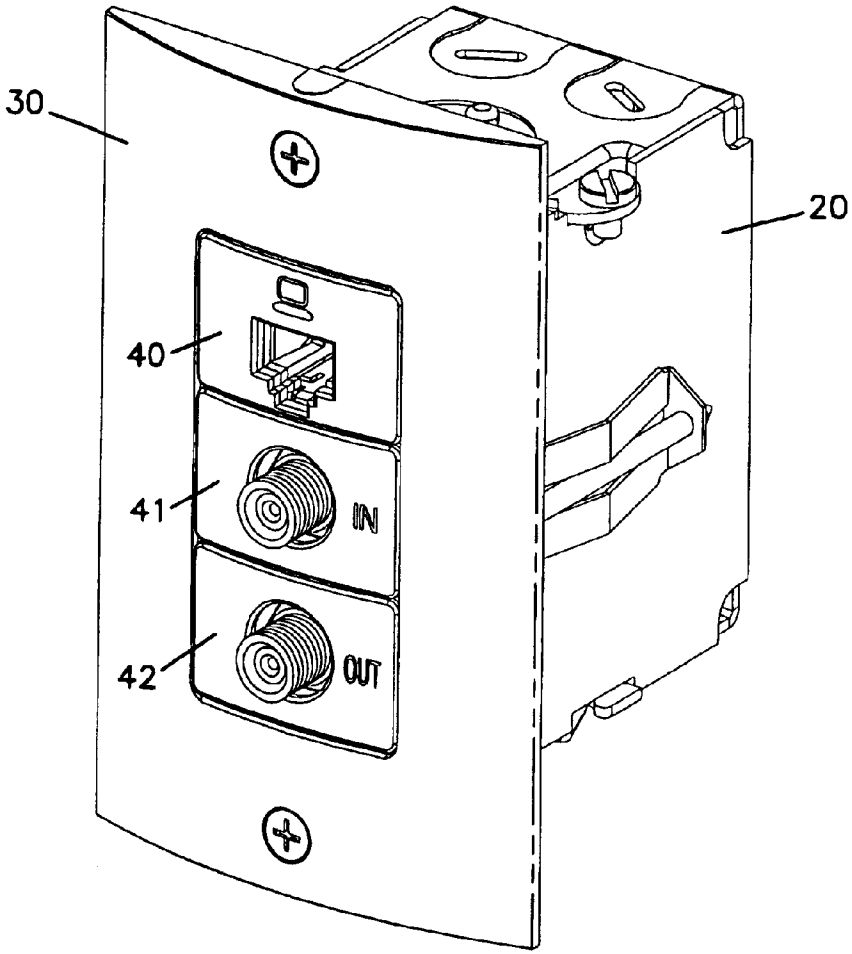
FIG. 4 is a front perspective view of the assembly of FIG. 1.
Figure 34:
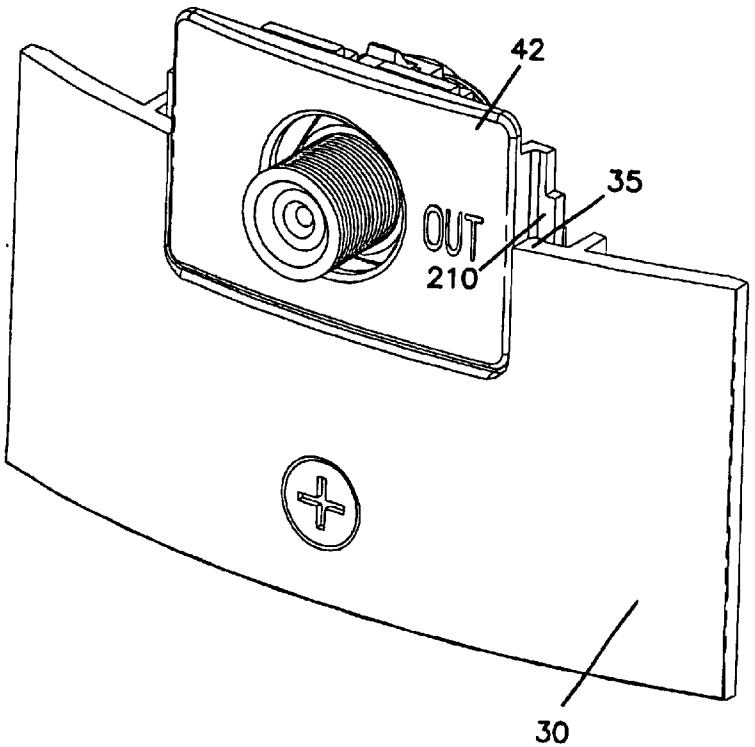
FIG. 34 is a partial cross sectional front perspective view of the assembly of FIG. 6 along line A—A.

The insert piece 110 includes retention members 100 extending from opposed sides of the middle member 112. The retention members 100 have a front surface 210 which is set back from the front surface 205 of the middle member 112 of the insert piece 110 thereby forming a shoulder. When the insert member 110 is coupled to the cover plate 30 and strap 50, the retention members 100 are received by the shelves 90 of the strap 50 so that the retention members 100 are retained between a back side 33 of the cover plate 30 and the strap 50. Specifically, an aperture edge 35 which defines the plate aperture 68 traps the retention members 100 of the insert piece 110 into opposed shelves 90 of the strap 50. As shown in FIGS. 34 and 35, a back side 36 of the aperture edge 35 abuts the front surface 210 of the retention members 100. When the cover plate 30 and strap 50 are coupled to the outlet box 20 as shown in FIGS. 4 and 5, the insert pieces 40–42 cannot be removed from the assembly without first removing the cover plate 30. The cover plate 30 prevents the removal of the insert pieces. The insert pieces, in turn, prevent the modules 60 and 62 from being removed from the assembly.

The insert pieces may also include tabs 102 extending from the rear surface 206 of the middle member 112. The insert tabs 102 are sized to be received by the tab slots 92 defined by the strap 50. The tabs 102 may be configured to wedge or friction fit into tab slots 92 so that the frictional force of the tabs 102 in the tab slots 92 will hold the insert pieces in a mating arrangement with strap 50 during assembly. Insert tabs 102 assist in aligning the insert piece relative to the strap 50 and improve the ease of assembly.

The retention members 100 may also include extensions 211. As shown in FIG. 35, when the insert members are assembled with the strap 50 the extensions 211 extend beyond side edges 213 of the strap 50. The extension members 211 provide a surface for easy removal of the insert pieces from the strap 50.

Figure 36:
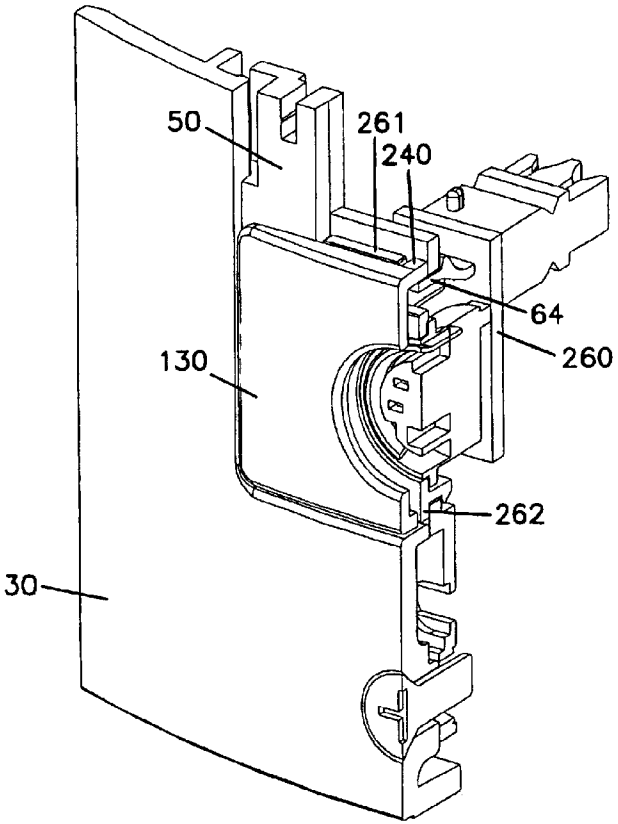
FIG. 36 is a cutaway perspective view of an assembly according to the present invention.

As shown in FIG. 36, the insert pieces may also include an orientation tab 240. Orientation tab 240 extends from the rear surface 206 of the insert piece 130. Insert piece 130 is an s-video insert piece which includes a slightly off-center connector aperture 133. In order to assist in properly orienting the insert piece 130, the orientation tab 240 has been included. The orientation tab 240 is received by the connector module 260 above the push tab 64 and adjacent module portion 261. If a user attempted to insert the insert piece up-side-down, the orientation tab 240 would be blocked by module portion 262.

The insert pieces of the present invention may be used to designate the various connectors and connector jacks in a multimedia outlet and may be swapped in and out of an outlet assembly as desired, but only upon prior removal of the cover plate 30. In this way the insert pieces also prevent the snap-fit connector modules from being removed from the outlet without first removing the cover plate.

Since many embodiments of the invention can be made without departing from the spirit and scope of the invention, the invention resides in the claims hereinafter appended.

What is claimed is:

1. A cover assembly for covering an open end of an outlet box, the outlet box having a strap, the assembly comprising:

an insert piece having a middle member and two retention members, the retention members extending from opposed sides of the middle member, the retention members having a front surface recessed from a front surface of the middle member; and a cover plate having a front side and a back side, the cover plate defining a fastener hole, the cover plate defining a plate aperture, wherein the middle member of the insert piece may be received in the plate aperture from the back side of the cover plate so that a back side of the cover plate abuts the front surface of the retention members of the insert piece, wherein the insert piece includes a tab on a back side of the middle member, and wherein the strap defines a tab slot which receives the tab of the insert piece.

2. The cover assembly of claim 1 wherein the insert piece defines a connector aperture.

3. The cover assembly of claim 1 wherein a front side of the middle member of the insert piece includes at least one designation figure.

4. The cover assembly of claim 1 wherein the insert piece is a first insert piece and wherein the assembly further comprises a second insert piece having a middle member and two retention members, the retention members extending from opposed sides of the middle member, the retention members of the second insert piece each having a front surface, wherein the second insert piece may be received by the plate aperture from the back side of the cover plate so that the plate aperture receives the middle member of the second insert piece and the back side of the cover plate abuts the front surface of the retention members of the second insert piece.

5. A cover assembly for covering an open end of an outlet box, the assembly comprising:

a strap having a front surface and a back surface, the strap defining at least one mounting aperture for receiving a cable connector, wherein the strap is adapted to engage a releasable tab of the cable connector, the strap having a first side and a second side;

an insert piece having a middle member and two retention members, the retention members extending from opposed sides of the middle member, the retention members each having a front surface;

a cover plate having a front side and a back side, the cover plate defining a fastener hole, the cover plate defining a plate aperture, wherein the insert piece may be received by the plate aperture from the back side of the cover plate so that the middle member is received in the plate aperture and the back side of the cover plate abuts the front surfaces of the retention members of the insert piece; and wherein the cover plate may be coupled to the strap so that the middle member of the insert piece overlaps at least a portion of the mounting aperture of the strap.

6. The cover assembly of claim 5 wherein the sides of the strap each define a recessed shelf which receive the retention members of the insert piece so that the retention members of the insert piece are retained between the cover plate and the recessed shelf of the strap.

7. The cover assembly of claim 6 wherein the insert piece defines a connector aperture.

8. The cover assembly of claim 7 further comprising a cable connector module housing a cable connector, the connector module received in the mounting aperture of the strap, the connector of the connector module received by the connector aperture of the insert piece.

9. The cover assembly of claim 5 wherein the insert piece includes a tab on a back side of the middle member, and wherein the strap defines a tab slot which receives the tab of the insert piece.

10. The cover assembly of claim 5 wherein a front side of the middle member of the insert piece includes at least one designation figure.

11. The cover assembly of claim 5 wherein the insert piece is a first insert piece and wherein the assembly further comprises a second insert piece having a middle member and two retention members, the retention members extending from opposed sides of the middle member, the retention members of the second insert piece each having a front surface, wherein the second insert piece may be received by the plate aperture from the back side of the cover plate so that the plate aperture receives the middle member of the second insert piece and the back side of the cover plate abuts the front surface of the retention members of the second insert piece.

12. An outlet box assembly comprising:

a telecommunications outlet box;

a strap having a front surface and a back surface, the strap defining at least one mounting aperture for receiving a cable connector, wherein the strap is adapted to engage a releasable tab of the cable connector, the strap having a first side and a second side, the strap being coupled to the open end of the outlet box;

an insert piece having a middle member and two retention members, the retention members extending from opposed sides of the middle member, the retention members defining two side shoulders each having a front surface;

a cover plate having a front side and a back side, the cover plate defining a fastener hole, the cover plate defining a plate aperture defined by an aperture edge, wherein the insert piece is received by the plate aperture from the back side of the cover plate so that the aperture edge of the plate aperture abuts the front surfaces of the side shoulders of the insert piece;

wherein the cover plate is coupled to the outlet box so that the strap is between the outlet box and the cover plate and so that the middle member of the insert piece overlaps at least a portion of the mounting aperture of the strap.

13. The assembly of claim 12 further comprising a connector module received by the mounting aperture of the strap.

14. The assembly of claim 12 wherein the sides of the strap each define a recessed shelf which receive the retention members of the insert piece so that the retention members of the insert piece are retained between the cover plate and the recessed shelf of the strap.

15. The assembly of claim 14 wherein the insert piece defines a connector aperture.

16. The assembly of claim 15 further comprising a cable connector module housing a cable connector, the connector module received in the mounting aperture of the strap, the connector of the connector module received by the connector aperture of the insert piece.

17. The assembly of claim 12 wherein the insert piece includes a tab on a back side of the middle member, and wherein the strap defines a tab slot which receives the tab of the insert piece.

18. The assembly of claim 12 wherein a front side of the middle member of the insert piece includes designation figures.

19. The assembly of claim 12 wherein the insert piece is a first insert piece and wherein the assembly further comprises a second insert piece having a middle member and two retention members, the retention members extending from opposed sides of the middle member, the retention members of the second insert piece each having a front surface, wherein the second insert piece may be received by the plate aperture from the back side of the cover plate so that the plate aperture receives the middle member of the second insert piece and the back side of the cover plate abuts the front surface of the retention members of the second insert piece.

20. A one piece insert for an outlet box cover assembly, the insert comprising:

a middle member, the middle member having a front surface, and a rear surface;

a tab extending from the rear surface of the middle member in a direction perpendicular to the rear surface of the insert; and two retention members extending from opposed sides of the middle member, the retention members each having a front surface, the front surface of the retention members being recessed from the front surface of the middle member.

21. The insert of claim 20 wherein the front surface of the middle member includes designation figures.

22. The insert of claim 20 further comprising a second tab extending from the rear surface of the middle member in a direction perpendicular to the rear surface of the insert.

23. A strap for an outlet box cover assembly, the strap comprising:

a strap body, the strap body having a front surface, a back surface, a first side and a second side;

wherein the strap body defines at least one mounting aperture for receiving a cable connector;

wherein the first and second sides of the strap body each define a recessed shelf;

wherein the strap body defines a fastener hole for receiving a fastener to couple the strap to a telecommunications outlet box; and wherein the strap body defines a tab slot for receiving a tab of an insert piece.

24. The strap of claim 23 wherein the strap body defines two corresponding tab slots for each mounting aperture, the tab slots being on opposed sides of the corresponding mounting aperture and wherein the strap defines a pair of opposed recessed shelves for each mounting aperture.

25. An outlet box assembly comprising:

an outlet box having an open end;

a cover plate having a front side and a back side, the cover plate defining a plate aperture, the cover plate coupled to the open end of the outlet box;

a cable connector including a flexible push tab coupled to the outlet box, and wherein the cable connector is positioned to be accessible through the plate aperture of the cover plate;

an insert piece having a front member and a retention member extending from a side of the front member, the insert piece being positioned between the back side of the cover plate and the connector so that the connector cannot be removed from the outlet box without first removing the cover plate from the outlet box.

26. The assembly of claim 25 wherein the front member of the insert piece defines a connector aperture for accessing the connector through the insert piece.

27. An outlet assembly comprising:

an outlet box assembly having an open end;

a cover plate having a front side and a back side, the cover plate defining a plate aperture, the cover plate coupled to the open end of the outlet box assembly;

a cable connector module positioned at the open end of the outlet box assembly, wherein the cable connector module includes a cable connector positioned to be accessible through the plate aperture of the cover plate;

a flexible mounting tab on the cable connector module including a ramped lip for snap mounting the cable connector module to the outlet box assembly;

means held by the cover plate for preventing the removal of the cable connector module from the outlet box assembly without first removing the means.

28. A cover assembly for covering an open end of an outlet box, the assembly comprising:

a strap having a front surface and a back surface, the strap defining at least one mounting aperture for receiving a cable connector, the strap having a first side and a second side;

an insert piece having a middle member and two retention members, the retention members extending from opposed sides of the middle member, the retention members each having a front surface;

a cover plate having a front side and a back side, the cover plate defining a fastener hole, the cover plate defining a plate aperture, wherein the insert piece may be received by the plate aperture from the back side of the cover plate so that the middle member is received in the plate aperture and the back side of the cover plate abuts the front surfaces of the retention members of the insert piece;

wherein the cover plate may be coupled to the strap so that the middle member of the insert piece overlaps at least a portion of the mounting aperture of the strap; and wherein the sides of the strap each define a recessed shelf which receive the retention members of the insert piece so that the retention members of the insert piece are retained between the cover plate and the recessed shelf of the strap.

29. The cover assembly of claim 28 wherein the insert piece defines a connector aperture.

30. The cover assembly of claim 29 further comprising a cable connector module housing a cable connector, the connector module received in the mounting aperture of the strap, the connector of the connector module received by the connector aperture of the insert piece.

31. A cover assembly for covering an open end of an outlet box, the assembly comprising:

a strap having a front surface and a back surface, the strap defining at least one mounting aperture for receiving a cable connector, the strap having a first side and a second side;

an insert piece having a middle member and two retention members, the retention members extending from opposed sides of the middle member, the retention members each having a front surface;

a cover plate having a front side and a back side, the cover plate defining a fastener hole, the cover plate defining a plate aperture, wherein the insert piece may be received by the plate aperture from the back side of the cover plate so that the middle member is received in the plate aperture and the back side of the cover plate abuts the front surfaces of the retention members of the insert piece;

wherein the cover plate may be coupled to the strap so that the middle member of the insert piece overlaps at least a portion of the mounting aperture of the strap;

wherein the insert piece includes a tab on a back side of the middle member; and wherein the strap defines a tab slot which receives the tab of the insert piece.

32. An outlet box assembly comprising:

a telecommunications outlet box;

a strap having a front surface and a back surface, the strap defining at least one mounting aperture for receiving a cable connector, the strap having a first side and a second side, the strap being coupled to the open end of the outlet box;

an insert piece having a middle member and two retention members, the retention members extending from opposed sides of the middle member, the retention members defining two side shoulders each having a front surface;

a cover plate having a front side and a back side, the cover plate defining a fastener hole, the cover plate defining a plate aperture defined by an aperture edge, wherein the insert piece is received by the plate aperture from the back side of the cover plate so that the aperture edge of the plate aperture abuts the front surfaces of the side shoulders of the insert piece;

wherein the cover plate is coupled to the outlet box so that the strap is between the outlet box and the cover plate and so that the middle member of the insert piece overlaps at least a portion of the mounting aperture of the strap; and wherein the sides of the strap each define a recessed shelf which receive the retention members of the insert piece so that the retention members of the insert piece are retained between the cover plate and the recessed shelf of the strap.

33. The assembly of claim 32 wherein the insert piece defines a connector aperture.

34. The assembly of claim 33 further comprising a cable connector module housing a cable connector, the connector module received in the mounting aperture of the strap, the connector of the connector module received by the connector aperture of the insert piece.

35. An outlet box assembly comprising:

a telecommunications outlet box;

a strap having a front surface and a back surface, the strap defining at least one mounting aperture for receiving a cable connector, the strap having a first side and a second side, the strap being coupled to the open end of the outlet box;

an insert piece having a middle member and two retention members, the retention members extending from opposed sides of the middle member, the retention members defining two side shoulders each having a front surface;

a cover plate having a front side and a back side, the cover plate defining a fastener hole, the cover plate defining a plate aperture defined by an aperture edge, wherein the insert piece is received by the plate aperture from the back side of the cover plate so that the aperture edge of the plate aperture abuts the front surfaces of the side shoulders of the insert piece;

wherein the cover plate is coupled to the outlet box so that the strap is between the outlet box and the cover plate and so that the middle member of the insert piece overlaps at least a portion of the mounting aperture of the strap;

wherein the insert piece includes a tab on a back side of the middle member; and wherein the strap defines a tab slot which receives the tab of the insert piece.

* * * * *